US007608029B2

(12) United States Patent
Weiss et al.

(10) Patent No.: US 7,608,029 B2
(45) Date of Patent: Oct. 27, 2009

(54) FREE STANDING BALLET BAR EXERCISE DEVICE

(75) Inventors: Roger E. Weiss, Foxboro, MA (US); Jennie Kwo, Canbridge, MA (US); Robert M. Podoloff, Framingham, MA (US); Luis Alberto Pedraza, West Roxbury, MA (US)

(73) Assignee: Fluidity Enterprises, Inc., Jacksonville, FL (US)

( * ) Notice: Subject to any disclaimer, the term of this patent is extended or adjusted under 35 U.S.C. 154(b) by 557 days.

(21) Appl. No.: 10/710,975

(22) Filed: Aug. 16, 2004

(65) Prior Publication Data

US 2006/0035750 A1 Feb. 16, 2006

(51) Int. Cl.
*A63B 21/00* (2006.01)

(52) U.S. Cl. ..... 482/142; 482/130; 482/34; 482/38

(58) Field of Classification Search ..... 297/377; 482/15, 16, 46, 38, 41, 35, 28; 5/617, 637, 5/648, 620, 607, 608, 633, 634
See application file for complete search history.

(56) References Cited

U.S. PATENT DOCUMENTS

| | | | | |
|---|---|---|---|---|
| 860,517 | A | 7/1907 | Berglund | |
| 3,800,338 | A * | 4/1974 | Smith | 5/617 |
| 4,008,892 | A * | 2/1977 | Nissen | 482/16 |
| 4,111,414 | A | 9/1978 | Roberts | |
| 4,126,307 | A | 11/1978 | Stevenson | |
| 4,696,470 | A | 9/1987 | Fenner | |
| 4,815,732 | A | 3/1989 | Mahvi | |
| 5,046,722 | A | 9/1991 | Antoon | |
| 5,080,352 | A | 1/1992 | Freed | |
| 5,277,676 | A | 1/1994 | Holland et al. | |
| 5,389,055 | A | 2/1995 | Gangloff | |
| 5,405,306 | A | 4/1995 | Goldsmith et al. | |
| 5,501,647 | A | 3/1996 | Snyder | |
| 5,662,556 | A | 9/1997 | Gangloff | |
| 5,776,037 | A * | 7/1998 | Millington | 482/91 |
| 6,336,414 | B1 | 1/2002 | Stewart et al. | |
| 6,415,723 | B1 | 7/2002 | Kopish et al. | |
| 6,652,419 | B1 | 11/2003 | Rota | |
| 6,699,162 | B2 | 3/2004 | Chen | |
| 6,743,152 | B2 | 6/2004 | Weiss | |
| 7,275,273 | B2 * | 10/2007 | Lary et al. | 5/634 |

* cited by examiner

*Primary Examiner*—Jerome Donnelly
(74) *Attorney, Agent, or Firm*—Clausen Miller PC

(57) ABSTRACT

A free standing, height adjustable ballet bar exercise device is provided. The device comprises a pair of legs, telescoping support arms pivotally attached to the legs and supporting a horizontal ballet bar disposed between the support arms, a lower cross bar connecting the legs intermediate their ends, an upper cross bar connecting the support arms, a backboard pivotally attached to the upper cross bar and releasably attached to the lower cross bar, and a floor board hingedly attached to the bottom edge of the backboard and adapted to lay flat on a floor to support the weight of the user. Preferably the backboard and floor board are covered by soft mats.

13 Claims, 8 Drawing Sheets

16
22
24
18
32
20
36
34
42
22
19
48
3A
44
46
38
18
3A
24
28
31
40
26
30

FREE STANDING BALLET BAR EXERCISE DEVICE

FIELD OF THE INVENTION

This patent relates to an exercise device. More particularly, this patent relates to a free standing ballet bar exercise device that can be collapsed for easy transport and storage.

DESCRIPTION OF THE RELATED ART

Conventional ballet bars usually are mounted to walls, and so are limited to rooms in which a bar can be mounted to a wall. For home users of exercise bars this limits the choice of rooms in which to exercise.

Thus it is an object of the present invention to provide an exercise bar that is free standing.

Another object of the invention is provide a free standing exercise bar that is easy to set up and can be collapsed for easy transport and storage, for example in a closet or under a bed.

Still another object of the invention is to provide an exercise bar that can be raised or lower to a desired height.

Further and additional objects will appear from the description, accompanying drawings, and appended claims.

SUMMARY OF THE INVENTION

The present invention is a free standing ballet bar exercise device that can be collapsed for easy transport and storage. In a preferred embodiment the device comprises a pair of legs and a pair of support arms pivotally attached to the legs at the legs' distal ends, an exercise bar mounted between the support arms at a height convenient to the user, a first lower cross bar connecting the legs intermediate their ends, an upper cross bar connecting the support arms, and a backboard attached to the upper cross bar and to the first lower cross bar to support the exercise bar in a free standing position. A second lower cross bar connects the legs at their distal ends. A floor board is hingedly attached to the backboard and adapted to lay flat on a floor to support the weight of the user. The floor board may be joined to the bottom edge of the backboard by one or more hinges. The hinges are releasably attached via a snap fit to the first lower cross bar and may be locked into place to the first lower cross bar by a spring loaded cammed handle. Cushioned mats cover the floor board and preferably the backboard as well.

The support arms are telescopic and can be extended or retracted to enable the height of the ballet bar 16 to be adjusted. Spring loaded knobs mounted at either end of the upper cross bar adjacent the support arms are used to lock the support arms at the desired height. Likewise, the legs can be telescopically extended to enhance the stability of the unit.

To use the exercise device, the user may stand, kneel, sit or otherwise rest on the floor board and stretch or perform exercises using the exercise bar. Because the floor board is attached to the backboard which is indirectly connected to the exercise bar, the user's weight and any downward force applied to the floor board maintains the ballet bar in position during use, even when the exercise bar is subjected to an upward force by the user.

The unit is easy to set up and can be folded into a relatively flat, compact shape for convenient shipping and storage.

THE DRAWINGS

DETAILED DESCRIPTION OF THE INVENTION

Figure 1:
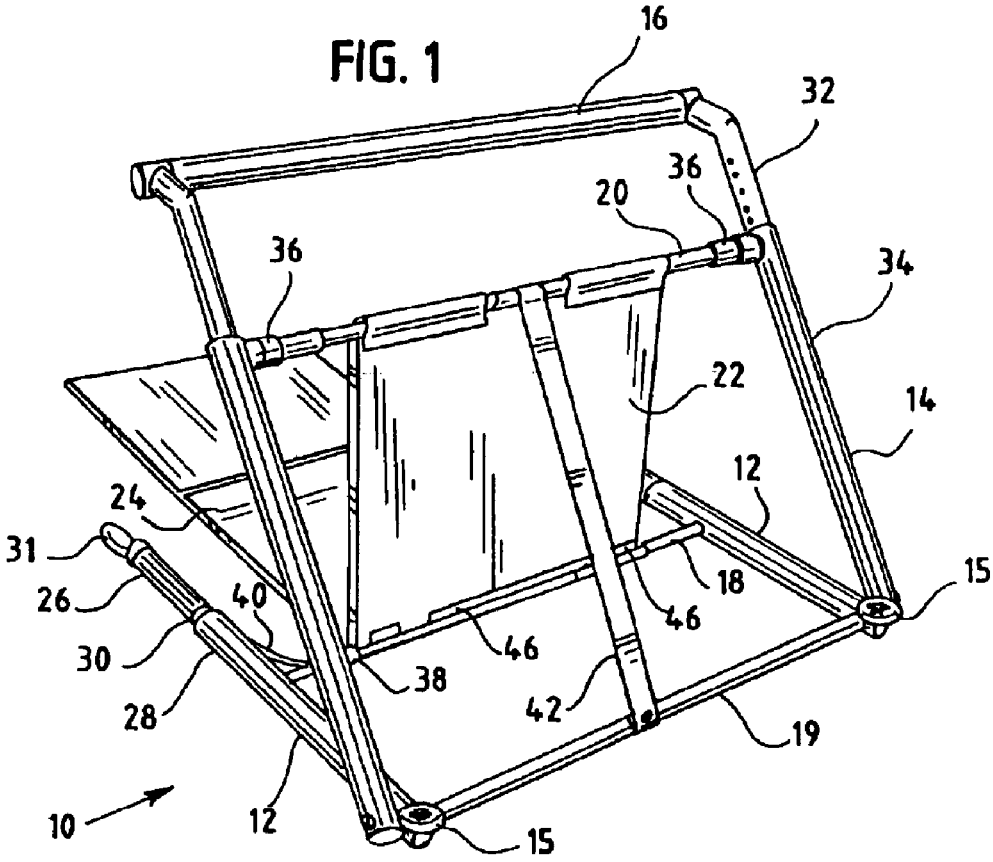
FIG. 1 is a perspective view of a free standing ballet bar exercise device according to the present invention.
Figure 2:
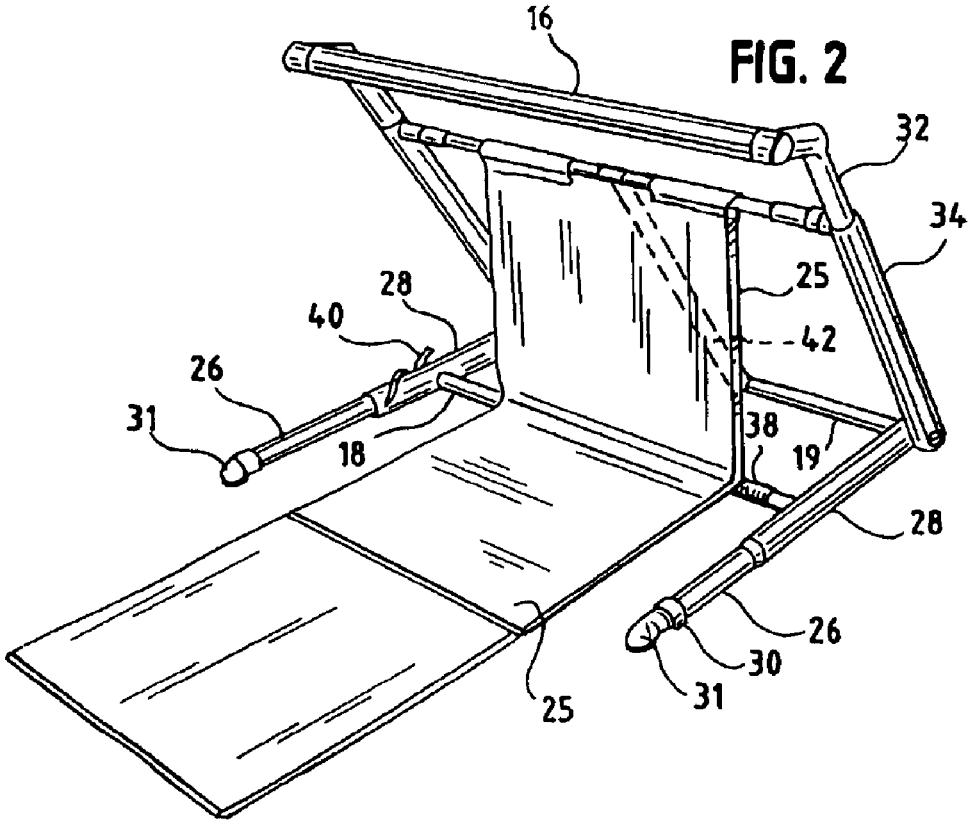
FIG. 2 is another perspective view of the free standing ballet bar exercise device of FIG. 1.
Figures 3, 3A:
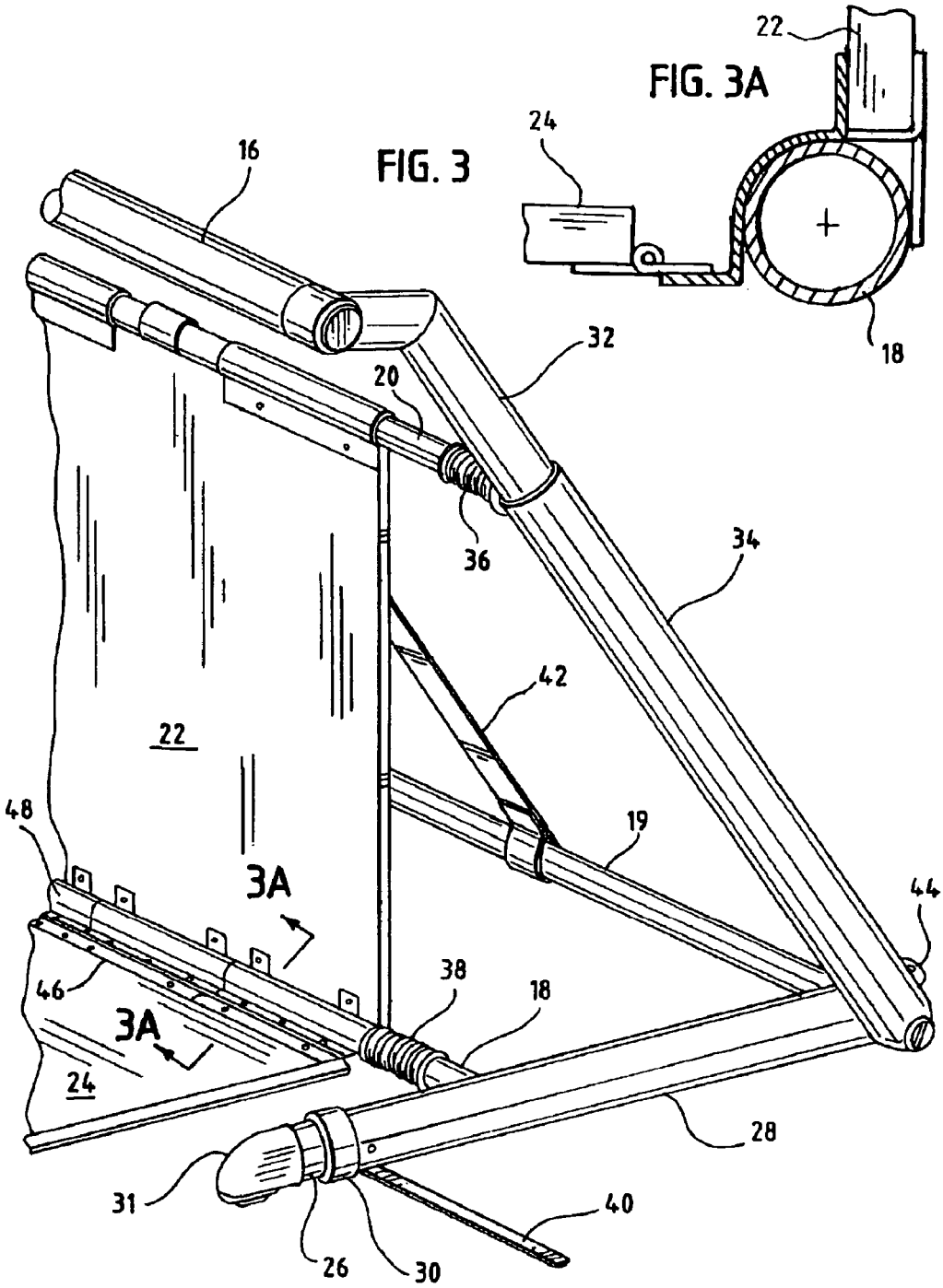
FIG. 3 is a close up perspective view in partial section of the free standing ballet bar exercise device of FIG. 1.
FIG. 3A is a cross-sectional view taken along line 3A-3A of FIG. 3.

Turning to the drawings, there is shown in FIG. 1 a preferred embodiment of the present invention, a free standing ballet bar exercise device 10. The device 10 comprises a pair of telescoping legs 12, each leg 12 having a proximal end which includes an optional rubber stabilizing foot 31 and a distal end 15 disposed away from the proximal end, telescoping support arms 14 pivotally attached to the legs 12 at the legs' distal ends 15, a height adjustable horizontal exercise bar 16 mounted between the support arms 14, a first lower cross bar 18 connecting the legs 12 intermediate their ends, a second lower cross bar 19 connecting the legs 12 at their distal ends 15, an upper cross bar 20 connecting the support arms 14, a backboard 22 pivotally attached to the upper cross bar 20 and releasably attached to the first lower cross bar 18, and a floor board 24 hingedly attached to the backboard 22. Preferably the backboard 22 and floor board 24 are covered by soft mats 25 as shown in FIG. 2.

Each leg 12 comprises an inner leg member 26 that slides within a sleeve or outer leg member 28. Detents 30 attached to the outer leg members 28 can be used to lock the inner leg member 26 in an extended position. To collapse the leg 12, the user pushes the inner leg member 26 inside the outer leg member 28. This releases the detent and the inner leg member 26 can be retracted inside the outer leg member 28. Feet 31 with rubber pads may be attached to the proximal ends of the inner leg members 26 for better stability.

Figure 4:
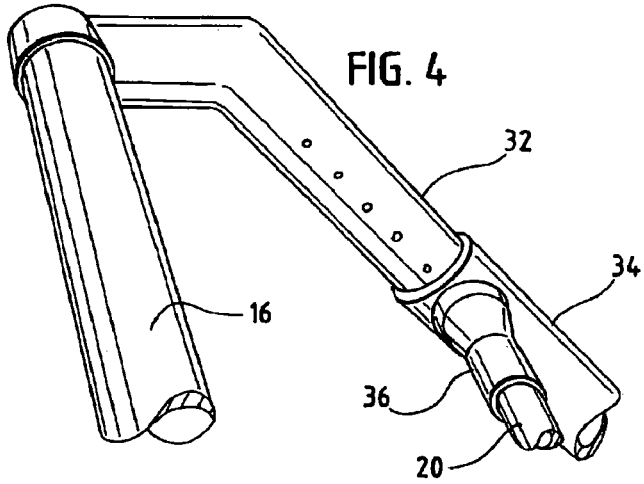
FIG. 4 is a close up view of the left side spring loaded knob of the free standing ballet bar exercise device of FIG. 1.
Figure 5:
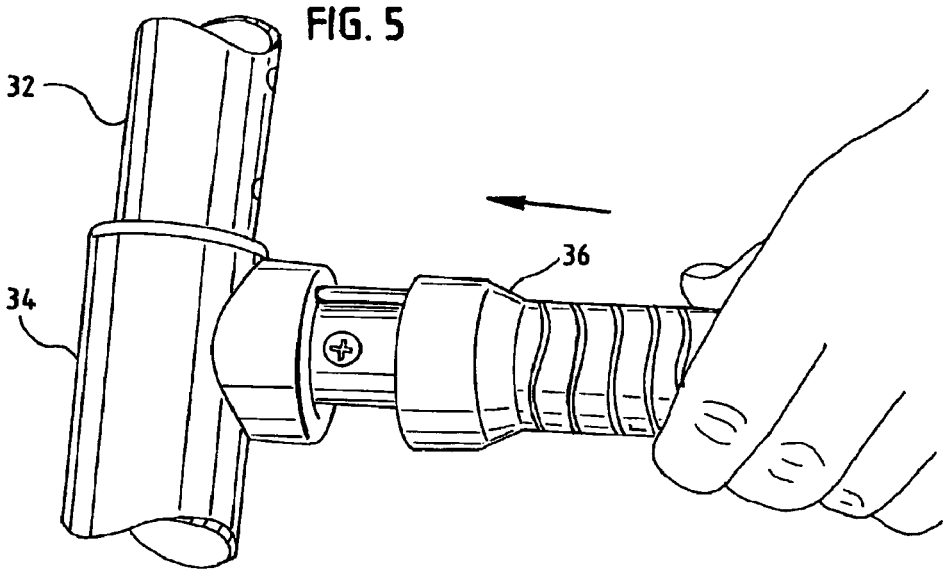
FIG. 5 is a close up view of the right side spring loaded knob of the free standing ballet bar exercise device of FIG. 1, shown as it is being released by a user.
Figure 6:
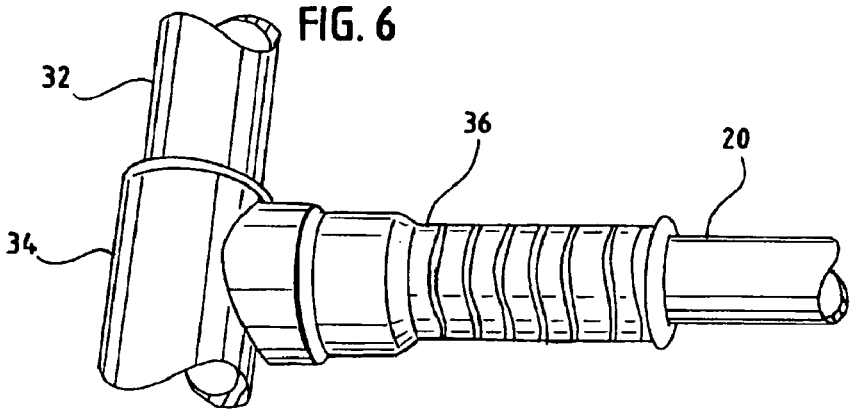
FIG. 6 is a close up view of the right side spring loaded knob of FIG. 5 after release.

Similarly, each support arm 14 comprises an inner arm member 32 that slides within a sleeve or outer arm member 34. The exercise bar 16 is mounted between the upper ends of the inner arm members 32. Preferably, the exercise bar 16 is inserted through openings in the support arms 14 and held in place by set screws. The height of the exercise bar 16 can be adjusted by sliding the inner arm members 32 within the outer arm members 34 and locking the inner arm members 32 into the desired position. As best shown in FIGS. 4-6, each inner arm member 32 is locked into position by means of a spring loaded knob 36 mounted at either end of the upper cross bar 20 adjacent the outer arm members 34. To adjust the height of the exercise bar 16, the spring loaded knobs 36 are retracted (pulled away from the support arms 14), which allows the inner arm members 32 to slide freely within the outer arm members 34. The exercise bar 16 can then be adjusted to the desired height. When the bar 16 is at the desired height the spring loaded knobs 36 are engaged as shown in FIG. 5. Preferably, the inner arm members 32 are angled toward the user as shown in the figures to better position the bar 16 over the floor board 24.

Figure 10:
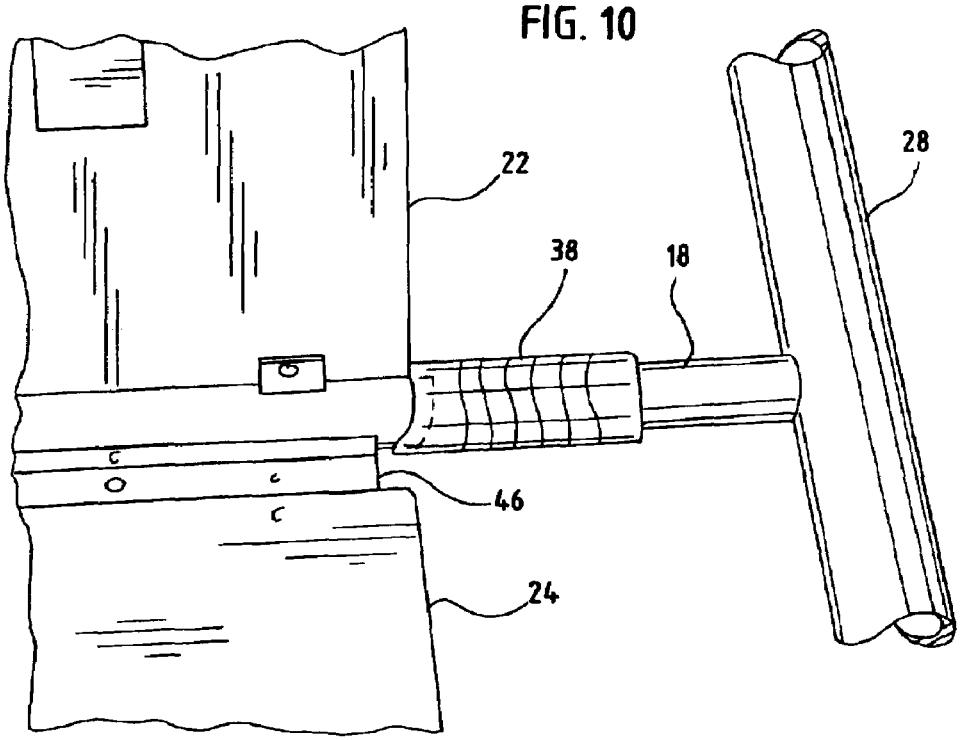
FIG. 10 is a close up view of the right side spring loaded handle of the free standing ballet bar exercise device of FIG. 1.
Figure 11:
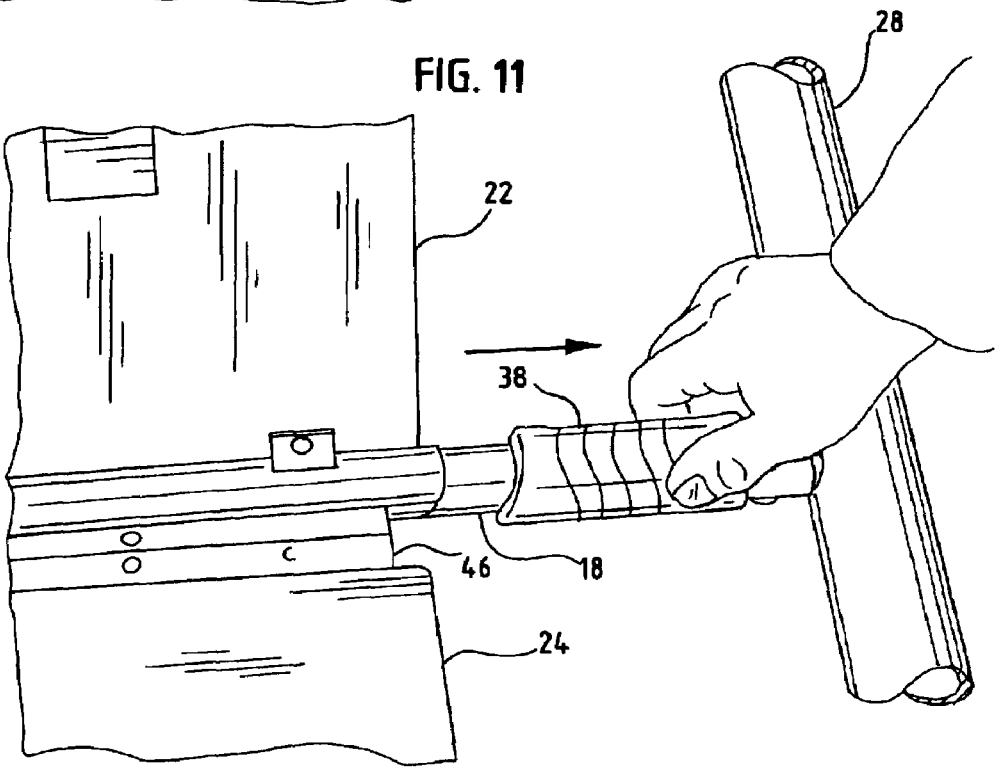
FIG. 11 is a close up view of the right side spring loaded handle of FIG. 10 shown being retracted by a user.

As perhaps best shown in FIGS. 3, 3A, 10 and 11, the floor board 24 is joined to the bottom edge of the backboard 22 by metal hinges 46 and arcuate connecting member 48. The backboard 22 is pivotally attached to the upper cross bar 20 and therefore indirectly to the exercise bar 16. The arcuate connecting member 48, and thus the backboard 22 and floor board 24, mates with the first lower cross bar 18 and is held or locked in place by a spring loaded cammed handle 38 (FIG. 10). To release the backboard 22 and floor board 24 from the first lower cross bar 18, the spring loaded handle 38 must be retracted as shown in FIG. 11. The floor board 24 may include more than one board hingedly connected together as shown in FIGS. 1 and 2 for a larger exercise surface.

Figure 7:
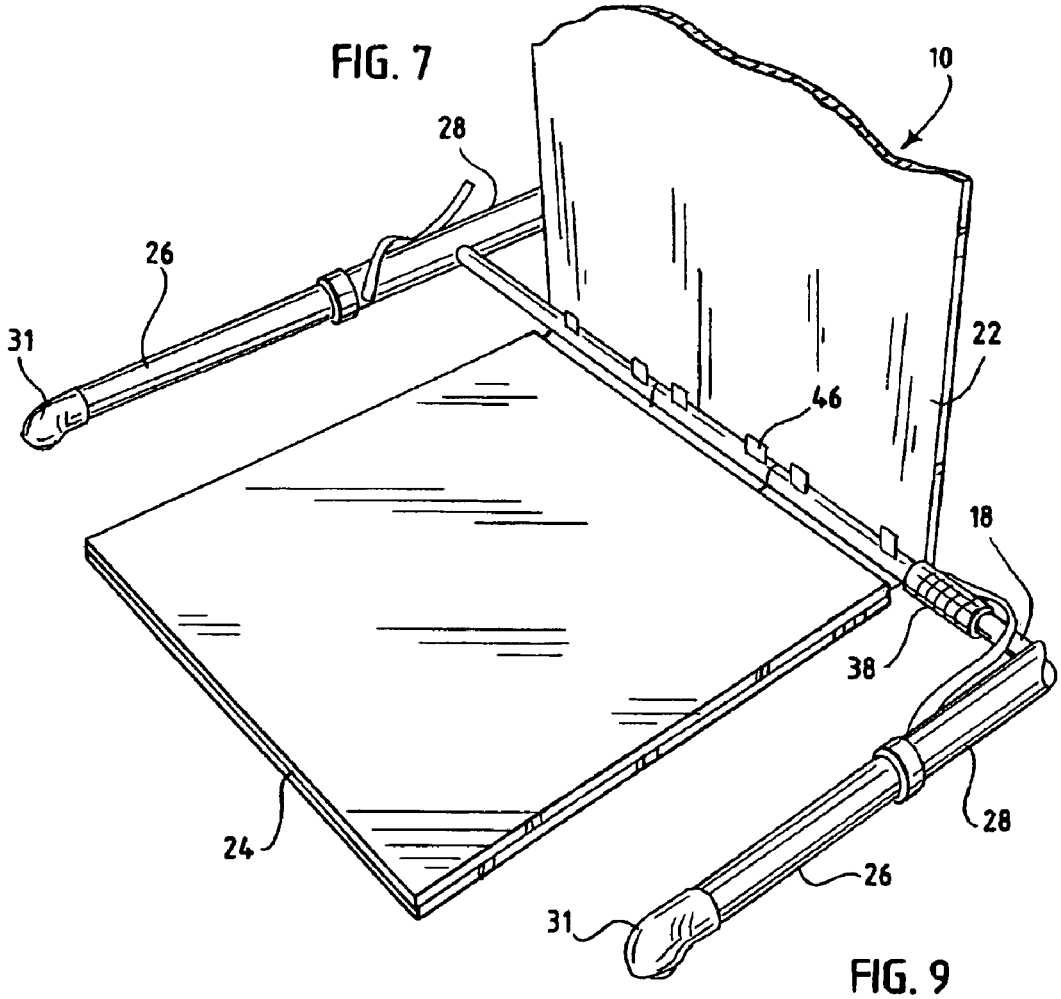
FIG. 7 is a perspective view in partial section of the free standing ballet bar exercise device of FIG. 1 with the mats removed.
Figure 8:
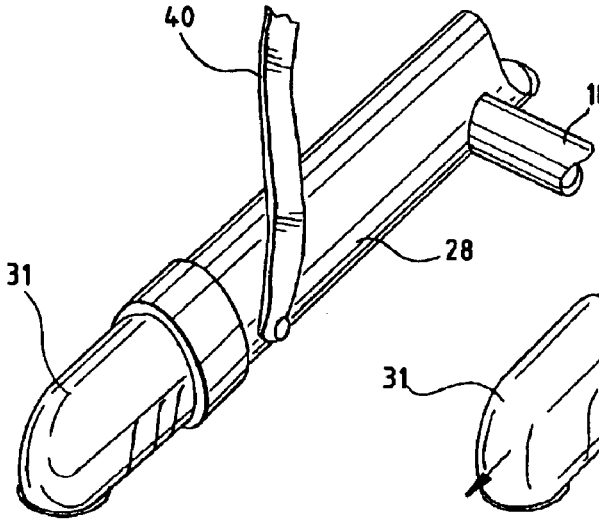
FIG. 8 is a close up view of the left side leg of the free standing ballet bar exercise device of FIG. 1.
Figure 9:
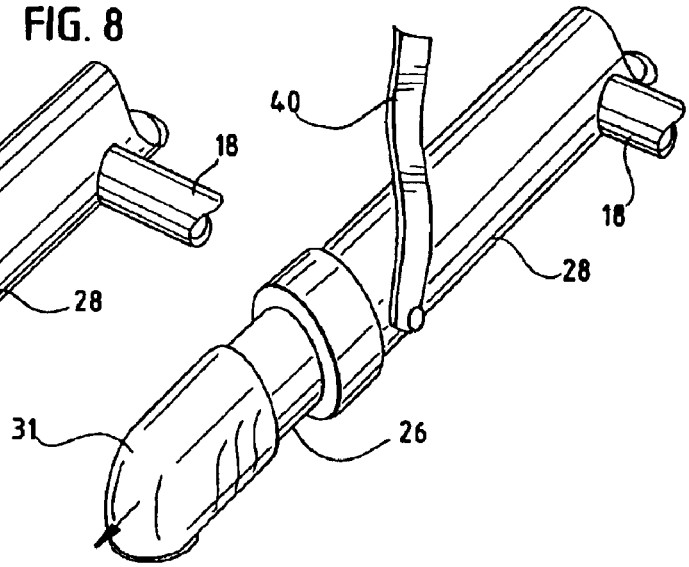
FIG. 9 is a close up view of the left side leg of the free standing ballet bar exercise device of FIG. 1 shown partially extended.

FIG. 7 is another close up view of the ballet bar exercise device 10, and FIGS. 8 and 9 are close up views of one of the telescoping legs 12. An optional leg strap 40 may be connected to the outer member 28 of each leg 12 and used to secure the unit 10 when it is folded, as explained in more detail below.

Figure 16:
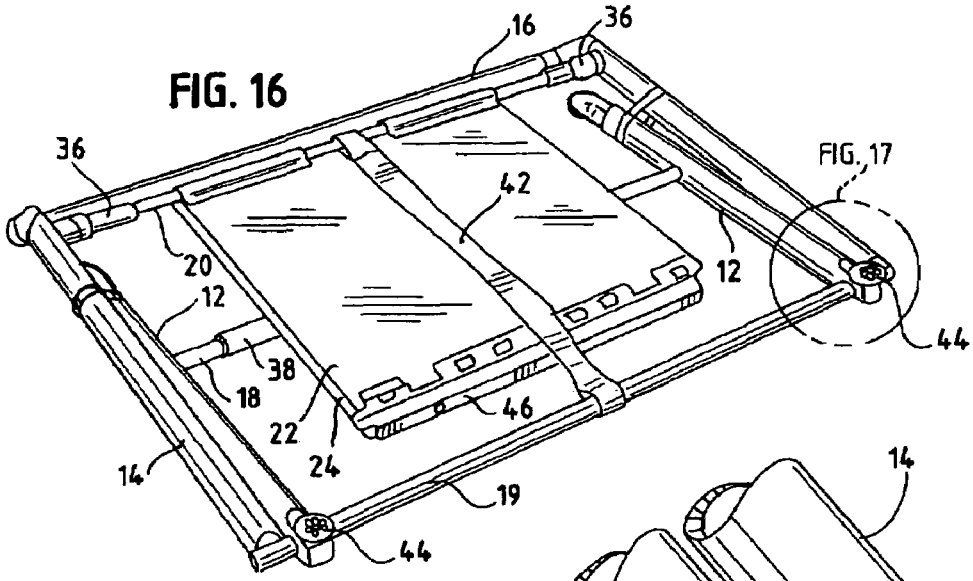
FIG. 16 is a perspective view of the free standing ballet bar exercise device of FIG. 12 shown completely collapsed and with the retaining strap secured.

To set up the unit 10, the user starts with the unit 10 lying on the floor with the rear surface of the backboard 22 facing up as shown in FIG. 16. First, leg straps 40 are undone. The user then lifts up on the wooden exercise bar 16 to unfold the unit 10. After unfolding the unit 10, the backboard 22 is locked into a vertical position by attaching it to the lower cross bar 18 via the hinges 46 and ensuring that the spring loaded handle 38 locks in place over the hinge 46. The floor board 24 should lay flat against the floor. The telescoping legs 12 can be fully extended for greater stability. The exercise bar 16 can be adjusted to the desired height by retracting the spring loaded knobs 36 mounted at each end of the upper cross bar 20 adjacent the support arms 14 and then pulling up on the bar 16. Before using the device 10 the user should make sure the spring loaded knobs 36 are locked into position.

To use the exercise device 10, the user may stand, kneel, sit or otherwise rest on the floor board 24 and stretch or perform exercises using the exercise bar 16. Because the floor board 24 is attached to the backboard 22 and indirectly to the exercise bar 16, the user's weight and any downward force applied to the floor board 24 maintains the device 10 in position during use, even when lifting up on the exercise bar 16.

Figure 12:
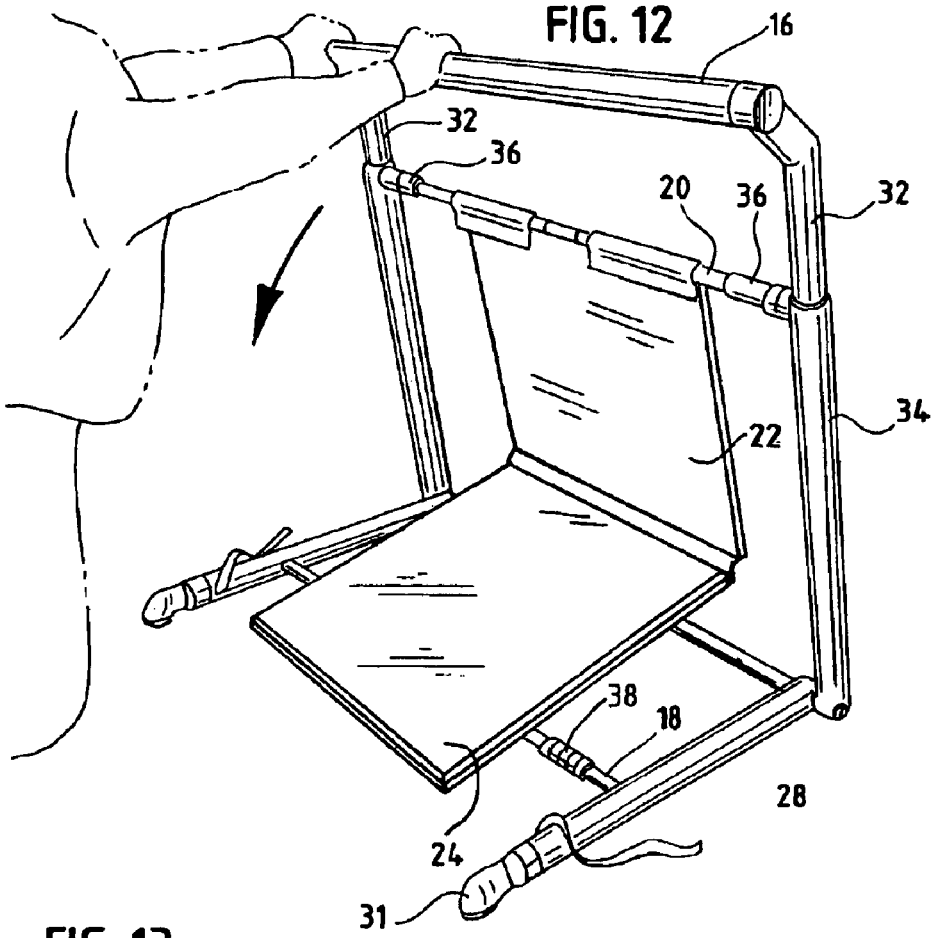
FIG. 12 is a perspective view of the free standing ballet bar exercise device of FIG. 1 shown prior to being collapsed by a user and with mats removed.
Figure 13:
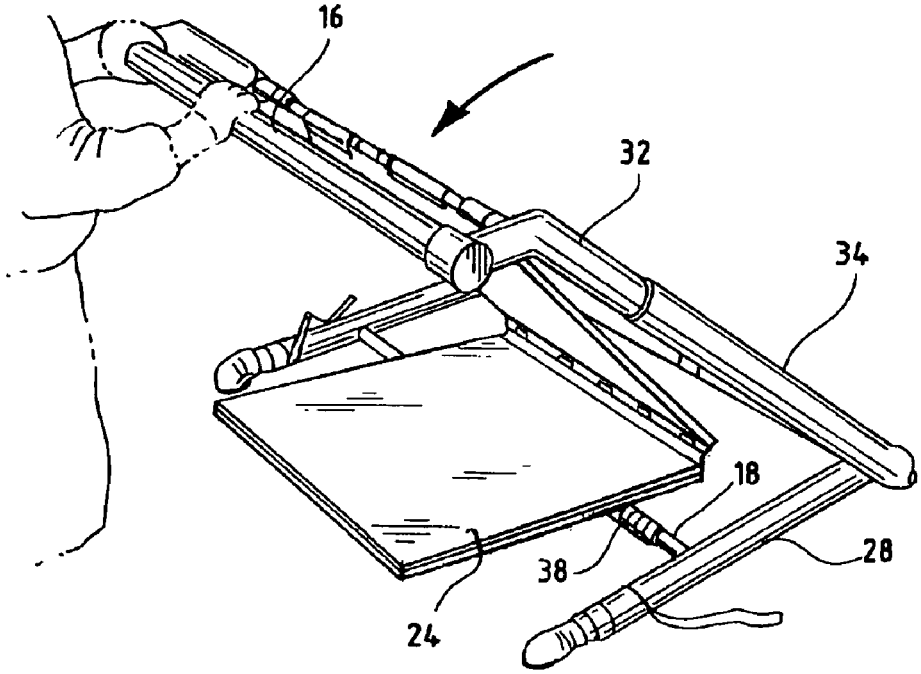
FIG. 13 is a perspective view of the free standing ballet bar exercise device of FIG. 12 shown partially collapsed.

The unit 10 can be folded into a relatively flat, compact shape for convenient shipping and storage. To fold the unit 10, the legs 12 are first collapsed telescopically. Next, the floor board 22 and backboard 24 are unsnapped from the lower cross bar 18 after retracting the spring loaded cammed handle 38. With the boards 22, 24 disconnected from the first lower cross bar 18, the boards 22, 24 can be swung rearward by pivoting the boards 22, 24 around the upper cross bar 20 until the backboard 22 is approximately are aligned with the support arms 14 as shown in FIG. 12. Next, as shown in FIGS. 12 and 13, the user can grab the exercise bar 16 and lower the support arms 14 until they are aligned with the legs 12.

Figure 14:
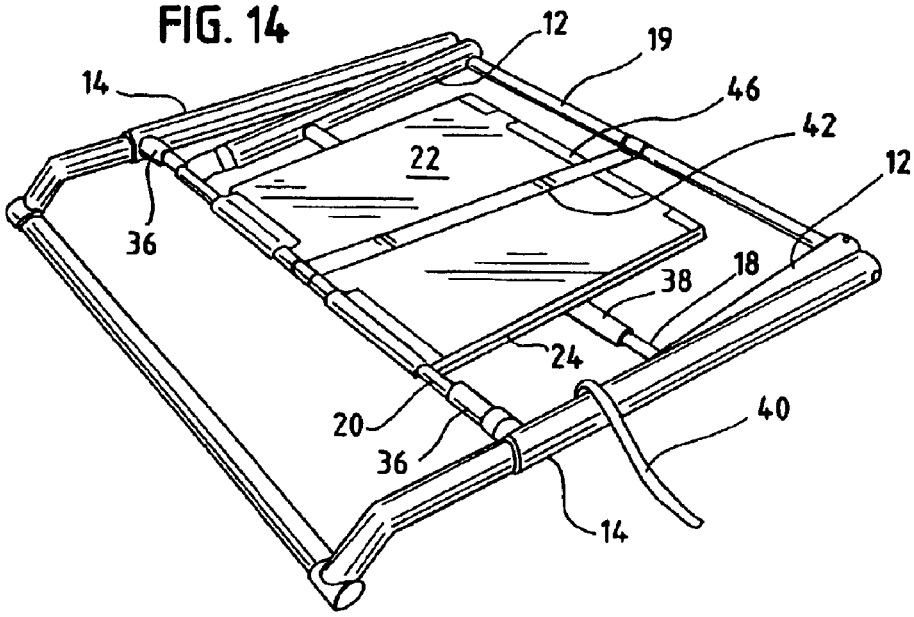
FIG. 14 is a perspective view of the free standing ballet bar exercise device of FIG. 12 shown completely collapsed but before the straps are fastened.
Figure 15:
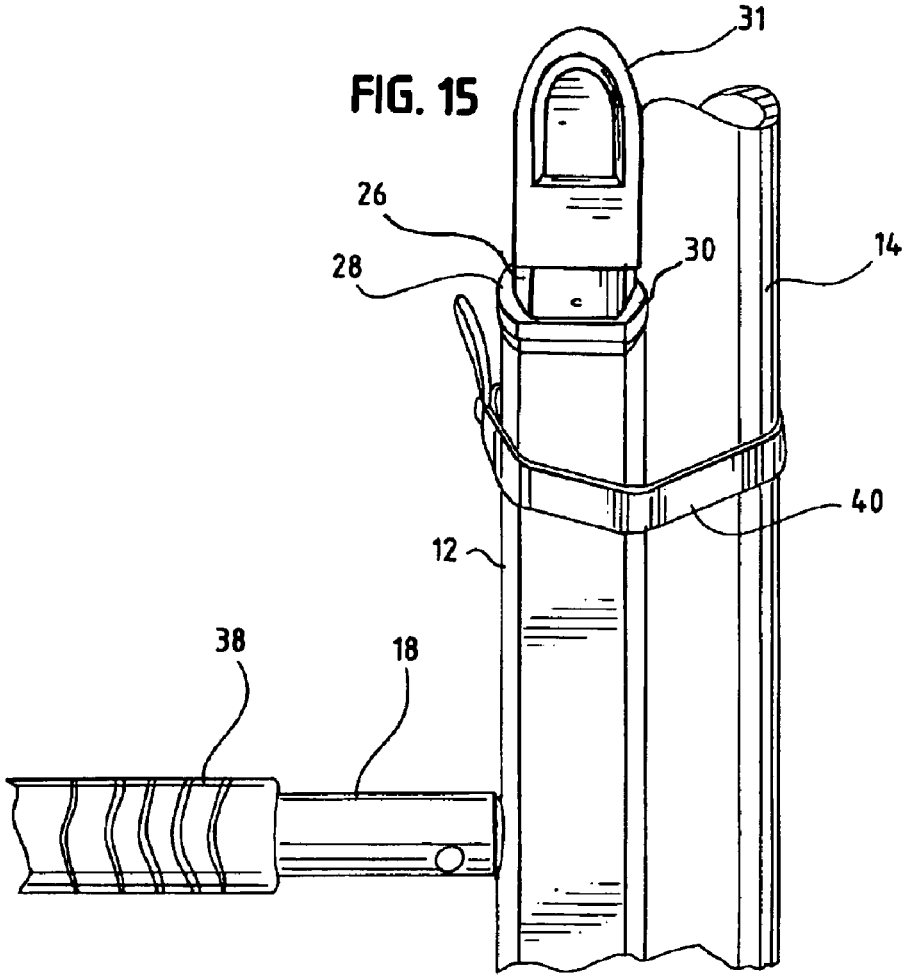
FIG. 15 is a close up view of the right side leg and support arm of the free standing ballet bar exercise device of FIG. 14 shown with leg straps secured.

FIG. 14 is a perspective view of the free standing ballet bar exercise device 10 after the arms 14 have been lowered. In this position, the user may secure the arms and legs together with the leg straps 40. FIG. 15 is a close up view of the right side leg 12 and supportarm 14 shown strapped together. The inner leg members 26 may be collapsed inside the outer leg members 28.

As shown in FIG. 16, a nylon retaining strap 42 is permanently attached to the second lower cross bar 19 and the upper cross bar 20. This strap holds the boards 22, 24 in place when the unit is being transported.

Figure 17:
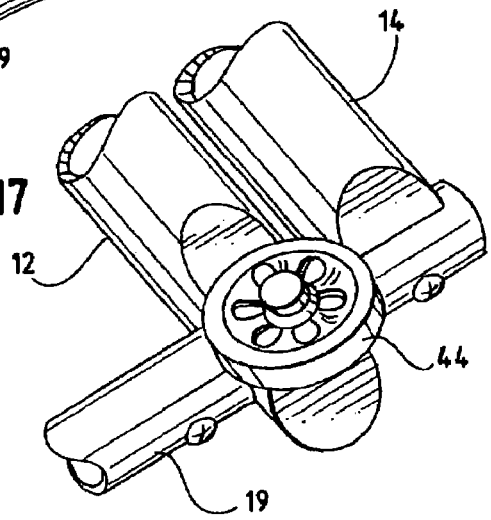
FIG. 17 is a close up view of the left side wheelof the free standing ballet bar exercise device of FIG. 16.
Figure 18:
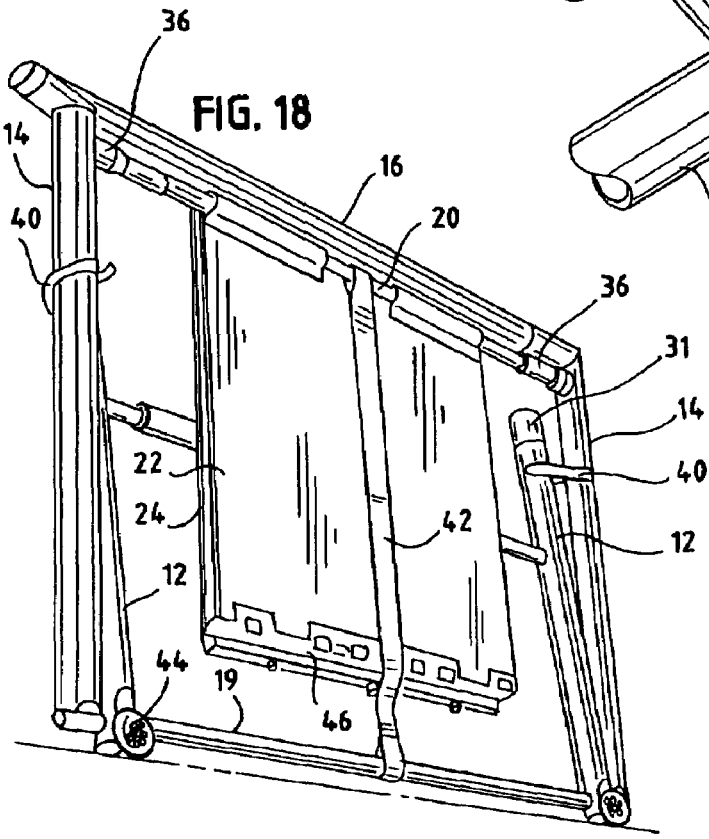
FIG. 18 is a perspective view of the free standing ballet bar exercise device of FIG. 16 shown balanced on its wheels.

The folded unit 10 shown in FIGS. 16-18 has a depth of only about six inches and is light enough to be easily carried by one person. Optional wheels 44 attached to the ends of the legs 12 where the legs 12 are connected to the second lower cross bar 19 allow the unit 10 to be rolled from place to place. The folded unit 10 can be stored in a small area, such as in a closet or under a bed.

Preferably, the exercise bar 16 is made of wood, the boards 22, 24 are made of plywood, and the legs 12 and arms 14 are made of metal or plastic. The mats 25 that cover the boards 22, 24 may be made of any suitable cushioned material.

Other modifications and alternative embodiments of the invention are contemplated which do not depart from the spirit and scope of the invention as defined by the foregoing teachings and appended claims. It is intended that the claims cover all such modifications that fall within their scope.

The invention claimed is:

1. A free standing ballet bar exercise device comprising:

a pair of legs, each leg having a proximal end and a distal end disposed away from the proximal end;

support arms pivotally attached to the legs at the legs' distal ends;

a horizontal exercise bar mounted between the support arms;

a first lower cross bar connecting the legs intermediate their ends;

an upper cross bar connecting the support arms;

a backboard attached to the upper cross bar and releasably attached to the first lower cross bar to support the exercise bar in a free standing position; and a release mechanism capable of releasing the backboard from the lower cross bar so that the device can be folded flat for storage.

2. The free standing ballet bar exercise device of claim 1 further comprising:

a floor board hingedly attached to the backboard and adapted to lay flat on a floor for supporting the weight of a user.

3. The free standing ballet bar exercise device of claim 2 further comprising:

a second lower cross bar connecting the legs at their distal ends.

4. The free standing ballet bar exercise device of claim 3 wherein the support arms are telescopic to enable the height of the ballet bar to be adjusted.

5. The free standing ballet bar exercise device of claim 4 wherein the legs telescopically extend to enhance the stability of the unit.

6. The free standing ballet bar exercise device of claim 4 further comprising a cushioned mat covering the floor board.

7. The free standing ballet bar exercise device of claim 4 further comprising spring loaded knobs mounted at either end of the upper cross bar adjacent the support arms, the spring loaded knobs adapted to lock the support arms at a desired height.

8. The free standing ballet bar exercise device of claim 4 wherein the floor board is joined to the bottom edge of the backboard by at least one hinge.

9. The free standing ballet bar exercise device of claim 8 wherein the at least one hinge is releasably attached via a snap fit onto the first lower cross bar.

10. The free standing ballet bar exercise device of claim 1 wherein at release mechanism is a spring loaded cammed handle.

11. A method of using the free standing ballet bar exercise device of claim 4 comprising the steps of:

placing at least a portion of the user's body on the floor board to apply a downward force on the floor board and thus stabilize the device; and using the exercise bar to stretch or perform exercises.

12. A free standing ballet bar exercise device comprising:

a pair of legs, each leg having a free, proximal end and a distal end disposed away from the proximal end;

a lower cross bar connecting the legs intermediate their ends;

a support arm pivotally attached to each leg at the leg's distal end, each support arm having a bottom end where the support arm is connected to a leg and a top end;

a horizontal exercise bar mounted to the top ends of the support arms;

an upper cross bar connecting the support arms intermediate the bottom and top ends; and a backboard rotatably attached to the upper cross bar and capable of extending substantially vertically to the floor to support the exercise bar in a free standing position;

wherein the backboard is releasably attached to the lower cross bar.

13. The free standing ballet bar exercise device of claim 12 further compromising a floor board hingedly attached to the back board and adapted to lay flat on a floor for supporting the weight of a user.

* * * * *